United States Patent [19]

White

[11] 4,330,887

[45] May 25, 1982

[54] TERRY CLOTH GLOVES (TERRY GRIPPERS)

[76] Inventor: Joanne White, 1702 E. 33rd St., Brooklyn, N.Y. 11234

[21] Appl. No.: 172,204

[22] Filed: Jul. 25, 1980

[51] Int. Cl.[3] ..... A41B 13/08; A47K 3/22

[52] U.S. Cl. ..... 2/16; 2/158

[58] Field of Search ..... 2/158, 167, 169, 159, 2/16

[56] References Cited

U.S. PATENT DOCUMENTS 3,327,320 6/1967 Forsyth ..... 2/158

3,885,249 5/1975 DeBrabander ..... 2/158

*Primary Examiner*—Doris L. Troutman

*Attorney, Agent, or Firm*—Richard L. Miller

[57] ABSTRACT

A pair of long-sleeved gloves designed particularly to hold an infant during a bath, the gloves being made of a terry cloth material so as to provide increased frictional grasp, each glove being of a length so as to extend above the elbow and on to the forearm, and a VELCRO band around the glove end for binding the glove securely around the arm.

1 Claim, 4 Drawing Figures

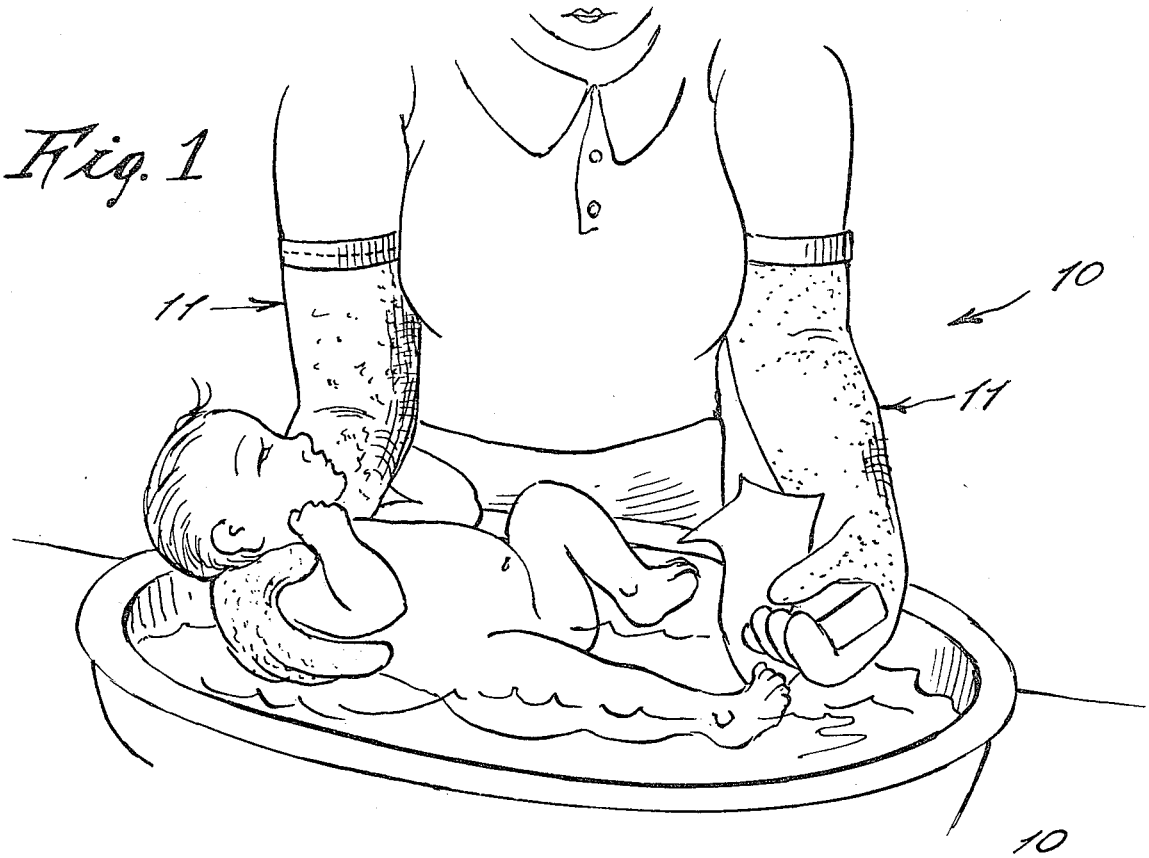
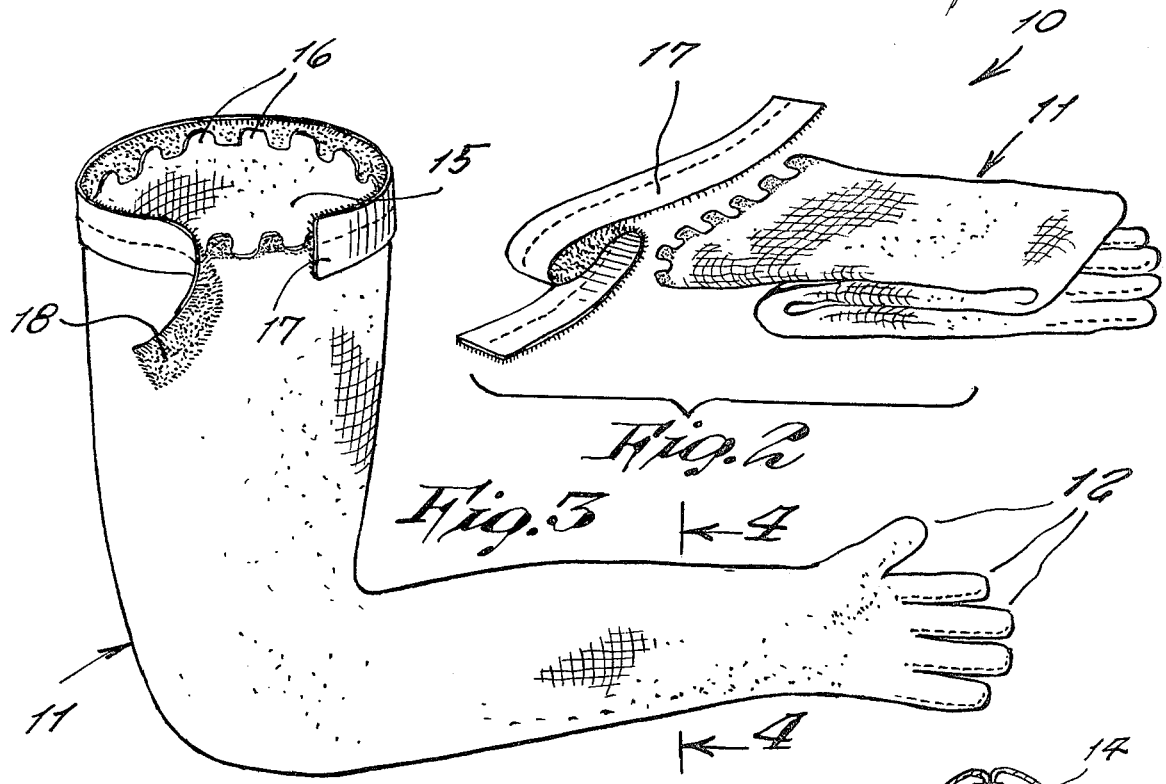
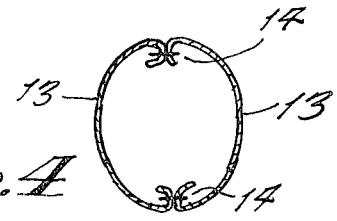
Fig. 4

TERRY CLOTH GLOVES (TERRY GRIPPERS)

BACKGROUND OF THE INVENTION

It is well known to most mothers tending a small infant or toddler, that the very smooth skin of the very young child is slippery when wet in a bath, so that it is difficult to hold the child from slipping and sliding from the mother's grasp. This lack of security while bathing the infant can be a most frightening aspect of motherhood, with fear of the infant sliding underwater or being dropped, so that this situation is accordingly in need of an improvement.

SUMMARY OF THE INVENTION

Therefore it is a principal object of the present invention to provide a pair of gloves for aiding the mother while bathing the infant, the gloves being made of a terry cloth material so as to have a frictional resistance against slippage.

Another object is to provide terry grippers which are soft and comfortable enough so as to contact an infant skin, while offering the security of a firm grasp.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a perspective view of the invention shown in operative use, bathing a small child.

FIG. 2 is a view of one of the gloves folded up, and a tape used therewith for taping its end to a person's upper arm.

FIG. 3 is a perspective view of one glove and showing how the tape is applied around one end.

FIG. 4 is a cross sectional view on line 4—4 of FIG. 3 showing the glove being conventionally made of two panels stitched together along opposite longitudinal edges so as to form a tubular construction.

DETAILED DESCRIPTION OF PREFERRED EMBODIMENT

Referring now to the drawing in greater detail, the reference numeral 10 represents terry grippers according to the present invention, wherein the same comprises a pair of long-sleeved gloves 11, each of which is worn on one hand and covers the lower arm and extends past the elbow and on the upper arm where it is secured.

The glove is sewn with fingers 12 into which the fingers and thumb of a wearer's hand are inserted.

The glove is made entirely of a terry cloth material, such as is used in towelling. It may be made of two flat panels 13 that are sewn together with stitch 14 along their edges.

The end of the glove having entry opening 15, into which the hand is inserted, is scalloped by being made with a toothed edge of loop pile fastener mating material that surrounds the upper arm with the teeth 16 thereof extending upwardly.

The present invention includes a separate band 17 which on one side is provided with mating loop pile fastener material 18 that is hooked on the ends of its filaments in a conventional loop pile fastener design. The band keeps the end of the glove from falling, by being wrapped around the toothed edge, as shown in FIG. 3, so to bind the edge firmly around the upper arm.

In use, the terry grippers provide friction for holding the infant so that the smooth, slippery skin thereof may be securely grasped.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A glove, comprising in combination, a long sleeved glove member made from a terry cloth material; said glove additionally including a separate band member for said glove member, said band member having loop pile fasteners on one of it's sides, said band member being removably applied around an end edge of said glove member when fitted on a wearer's arm; said glove member being of a length so as to extend from the finger tips of a hand, across the length of a lower arm, across an elbow and upon an upper arm of said wearer; said glove member being performed with a right angle at said elbow, and said glove member end edge being around an opening for entry of said arm into said glove member, said end edge being scalloped in shape wherein scallope of said end edges include loop pile fasteners of said band member.

* * * * *